US012546503B2

(12) United States Patent
Farrara et al.

(10) Patent No.: US 12,546,503 B2
(45) Date of Patent: Feb. 10, 2026

(54) TERMINATION VENT SCREEN ASSEMBLY FOR VENTILATION PIPES

(71) Applicants: Robert Nelson Farrara, Cambridge, NY (US); Cody Robert LaFlamme, Charleston, MA (US)

(72) Inventors: Robert Nelson Farrara, Cambridge, NY (US); Cody Robert LaFlamme, Charleston, MA (US)

( * ) Notice: Subject to any disclaimer, the term of this patent is extended or adjusted under 35 U.S.C. 154(b) by 380 days.

(21) Appl. No.: 18/164,137

(22) Filed: Feb. 3, 2023

(65) Prior Publication Data

US 2024/0263829 A1 Aug. 8, 2024

(51) Int. Cl.
*F24F 13/08* (2006.01)

(52) U.S. Cl.
CPC ..... *F24F 13/084* (2013.01)

(58) Field of Classification Search
CPC ..... F24F 13/082; F24F 13/0209; F24F 2007/001; F24F 2007/0025
See application file for complete search history.

(56) References Cited

U.S. PATENT DOCUMENTS

| | | | | |
|---|---|---|---|---|
| 2,799,518 | A * | 7/1957 | Anderson | F16L 37/008 285/283 |
| 3,472,030 | A | 10/1969 | Rieke | |
| 4,206,692 | A | 6/1980 | Johnston | |
| 5,452,546 | A | 9/1995 | Goddard | |
| 5,581,934 | A | 12/1996 | Arnold, Sr. | |
| 6,244,006 | B1 | 6/2001 | Shue et al. | |
| 6,474,365 | B1 | 11/2002 | Brown et al. | |
| 7,415,802 | B2 | 8/2008 | Froeter et al. | |
| 10,323,418 | B2 | 6/2019 | Karkheck et al. | |
| 10,617,113 | B2 | 4/2020 | Robinson | |
| 10,639,568 | B1 | 5/2020 | Carter | |
| 10,653,983 | B2 | 5/2020 | Kent | |
| 10,920,431 | B2 | 2/2021 | McNinch | |
| 2002/0166859 | A1 | 11/2002 | McGrew | |
| 2011/0272052 | A1 | 11/2011 | Lauridsen | |
| 2012/0258656 | A1 | 10/2012 | Raimondi | |
| 2015/0375151 | A1 | 12/2015 | Wydler et al. | |

* cited by examiner

*Primary Examiner* — Allen R. B. Schult

(74) *Attorney, Agent, or Firm* — Dunlap Bennett & Ludwig PLLC

(57) ABSTRACT

A termination vent screen assembly that selectively secures to different interfaces of a ventilation pipe system, regardless of their manufacturer. The termination vent screen assembly provides a free-open-area configuration that enables sufficient airflow and condensation moisture drainage. The assembly has a vent portion that nests in a universal fitting. The vent portion provide distal leg flanges to operatively associate with hubs or, when the leg flanges are folded onto themselves, operatively associate with pipes having smaller diameters than their hubs.

8 Claims, 20 Drawing Sheets

TERMINATION VENT SCREEN ASSEMBLY FOR VENTILATION PIPES

BACKGROUND OF THE INVENTION

The present invention relates to ventilation systems and piping and, more particularly, a universal termination vent screen assembly for ventilation pipes.

Ventilation piping is a common approach for enabling adequate air intake and adequate exhaust to or from, respectively, a ventilation system or appliance. Typically, the ventilation piping extends through a sidewall into an exterior environment, like the outdoors. Rodents and debris, however, can get into unscreened ventilation pipes extending outdoors, clogging airflow, and causing a nuisance. The current solution is to provide a conduit screen mated to the ventilation pipe by way of a qualified hub fitting to prevent these problems. Unfortunately, the current state of the art in conduit screening techniques have the following disadvantages.

First, currently some conduit screen assemblies detrimentally restrict airflow because of tight screen mesh. Similarly, current conduit screen assemblies lack the ability to drain water, typically built up through condensation, causing the built-up water to problematically freeze at colder temperatures.

Second, some conduit screens are not removable for replacement, cleaning, interchangeability, changing out for different size air flow openings, or the ability to remove the screen component from an assembly that fits on one type of conduit for standalone use in a smaller conduit type.

Third, some prior art screen conduits are limited in that they either associate with Polyvinyl chloride (PVC) material piping or Polypropylene (PP) material piping, but not both as PVC piping and PP piping may come in different size standards. Furthermore, current screen assemblies do not provide a removable screen portion that directly engages the ventilation (PVC or PP) piping. This is because current solutions tend to be designed specifically to fit into a PVC or PP qualified hub fitting—as opposed to directly fitting into a pipe.

Moreover, pursuant to the Gas Flue Ventilation Code, as of Jul. 1, 2020, many jurisdictions require all combustion ventilation pipes, fittings, and accessories to be made from PP and be ultraviolet (UV) resistant. Thus, PVC and steel material no longer meet code for combustion ventilation pipes in such jurisdictions, and current screens made of metal rust out quickly due to the above-mentioned moisture in the exhaust vent line. Again, many current vent assemblies have no feature to allow for drainage of condensation to prevent ice buildup and resulting pipe breakage.

As can be seen, there is a need for a universal termination vent screen assembly that selectively connects to the distal end of a ventilation pipe to prevent undesirables from entry, while enabling sufficient airflow and condensation moisture drainage. Furthermore, the present invention is adapted for installation on many different styles of ventilation piping, PP or PVC, regardless of their manufacturer, whereby the termination vent screen assembly can go over a ventilation pipe, into the ventilation pipe, into a hub fitting with a glue-style connection or a gasketed hub.

SUMMARY OF THE INVENTION

The present invention provides a termination vent screen assembly having approximately 95% or more "Free Open Area" (FOA) embodying uniquely engineered designed features preventing condensation freeze and airflow clogging of the ventilation pipe. The novel design features for water drainage are found on both the screen and the main body, and the FOA exceeds the minimum amount of airflow requirements.

The present invention embodies a vent screen snap on/off escutcheon wall plate that covers the gap around ventilation pipes, enabling attachment to a ventilation pipe at the interface of a wall without the need for adhesives or fasteners.

The present invention embodies a "universal" vent screening assembly configurable to connect a large variety of ventilation piping interfaces, such as fittings, gasketed or non-gasketed hubs or sockets for Polyvinyl chloride (PVC) and Polypropylene (PP) piping assemblies, as well as bare PVC or PP pipes.

The present invention may be made with 100% PP material (or other material that meets code), thereby offering UV resistance as mandated by some jurisdictions. The vent screen assembly may include a universal transition fitting and a removable screen portion, making the latter useable as a standalone product to fit directly into a pipe (as opposed to being part of the universal transition fitting that tends to fit over a pipe or fitting). The above-mentioned Gas Flue Ventilation Code (known as the Ventilation Piping Code in some areas) requires a transition fitting to be placed prior to connecting the vent screening, and the above-mentioned universal transition fitting of the present invention fits the bill as it embodies a transition part and thereby replaces the added expense of buying the prior art transition fitting.

Simply put, the vent screen system embodied in the present invention allows water drain and allows for incredible amount of "free open area" for sufficient airflow. Also, the device of the present invention allows for many connection configurations through the universal transition fitting and through an arrangement of "spider" legs on the vent portion. The present invention also embodies a wall plate that snaps on to the universal transition fitting that covers the gap around the receiving pipe, whereby the present invention can fit into different types of fittings and hubs or connect directly with different types of ventilation pipes.

In one aspect of the present invention vent assembly for a ventilation conduit, the vent assembly having a vent portion including the following: an arcuate body extending between a distal end and a proximal end; a plurality of legs radially spaced apart from the distal end, wherein each leg extend distally and upwardly so that the most distal ends of the plurality of legs define circle have a diameter approximately twenty to forty percent greater than a diameter of the arcuate body; and for each leg, a pivot connects the leg to the arcuate body so that the leg moves between a distal position to a proximal position projecting proximately and toward the arcuate body.

In another one aspect of the present invention the vent assembly further include, for each leg, a stop disposed distal of the pivot and angled outwardly and upwardly so as to define an outermost diameter when the leg is in the proximal position; a transition fitting being tubular and having distal portion and a proximate portion, wherein an outer diameter of the proximal portion is approximately at least five percent greater than a diameter of the distal portion; an arcuate notch between the distal portion and the proximal portion; a plurality of nodes spaced apart along the arcuate notch; an escutcheon plate dimensioned and adapted to snap on to the arcuate notch and the plurality of nodes, wherein the vent portion is dimensioned to be slidably received in the distal portion of the transition fitting.

These and other features, aspects and advantages of the present invention will become better understood with reference to the following drawings, description, and claims.

DETAILED DESCRIPTION OF THE INVENTION

Figure 1:
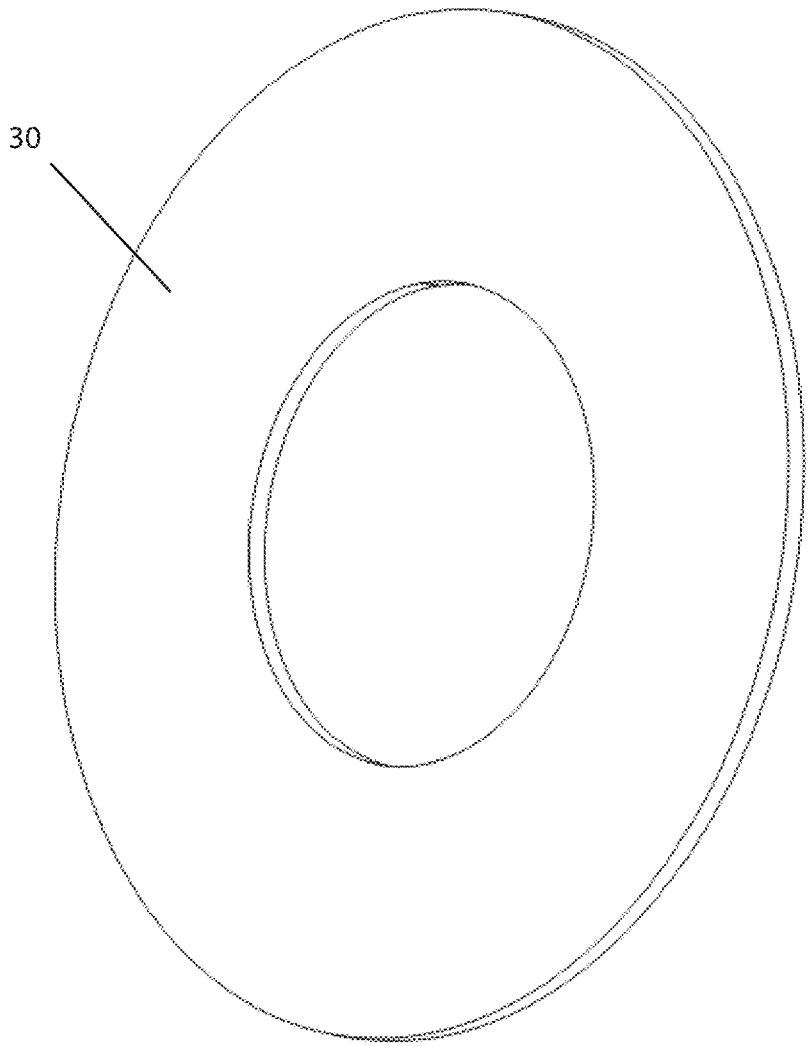
FIG. 1 is a perspective view of an exemplary embodiment of an escutcheon plate 30 of the present invention.
Figure 2:
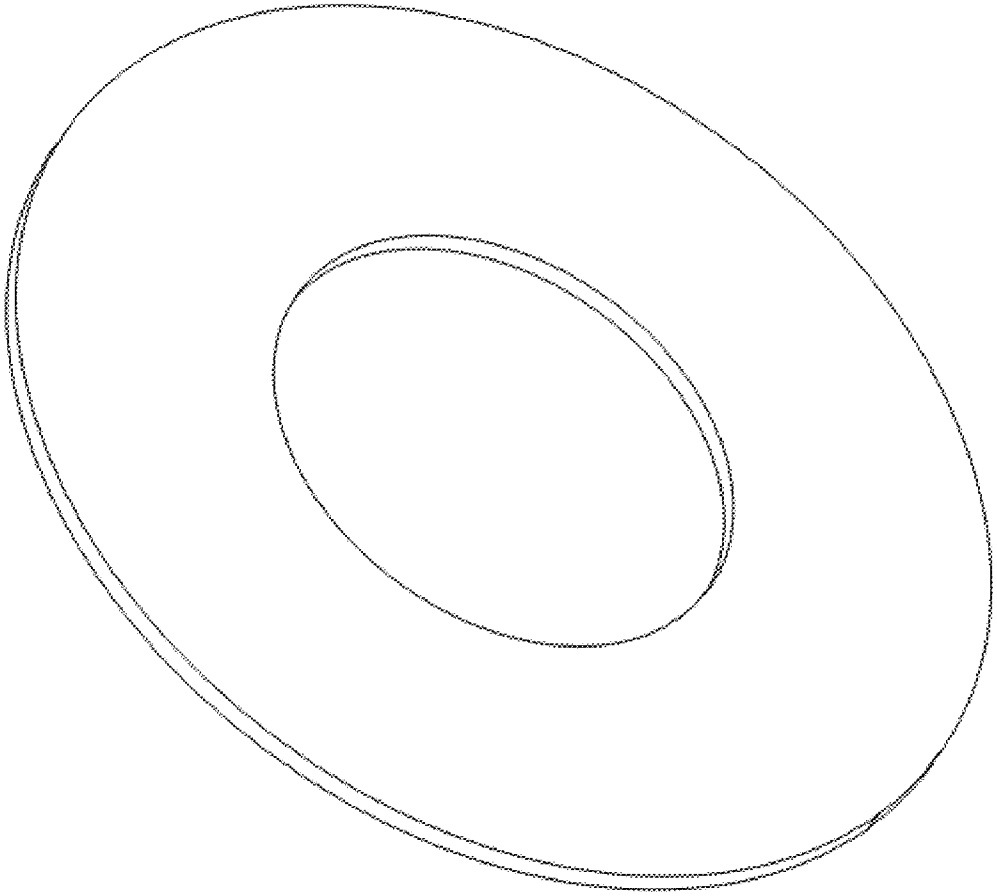
FIG. 2 is a perspective view of an exemplary embodiment of the escutcheon plate 30 of the present invention.
Figure 3A:
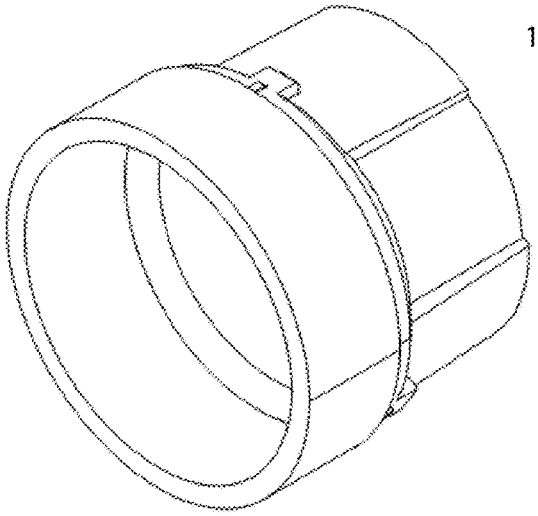
FIG. 3A is a proximal perspective view of an exemplary embodiment of a universal transition fitting 10 of the present invention.
Figure 3B:
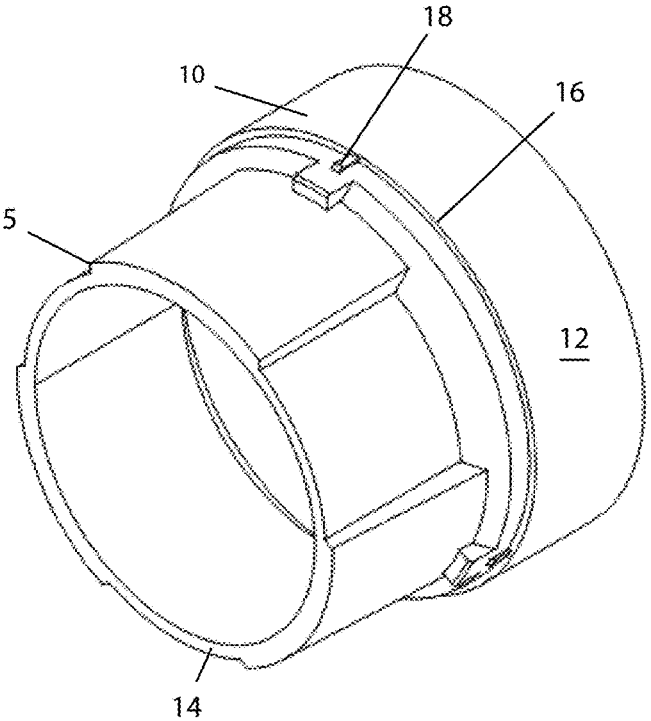
FIG. 3B is a proximal perspective view of an exemplary embodiment of the universal transition fitting 10 of the present invention.
Figure 4:
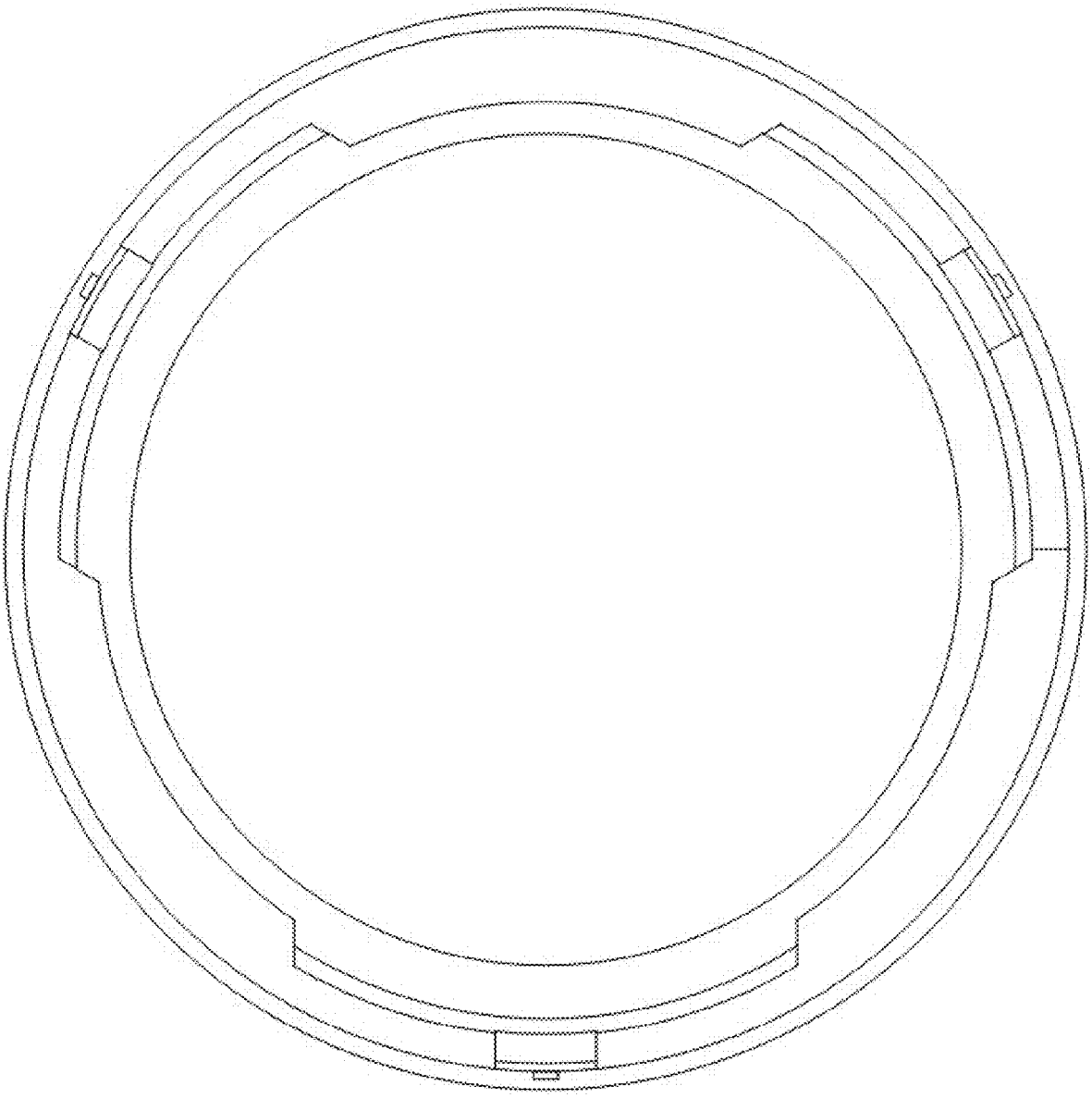
FIG. 4 is a plan view of an exemplary embodiment of the universal transition fitting 10 of the present invention.
Figure 5:
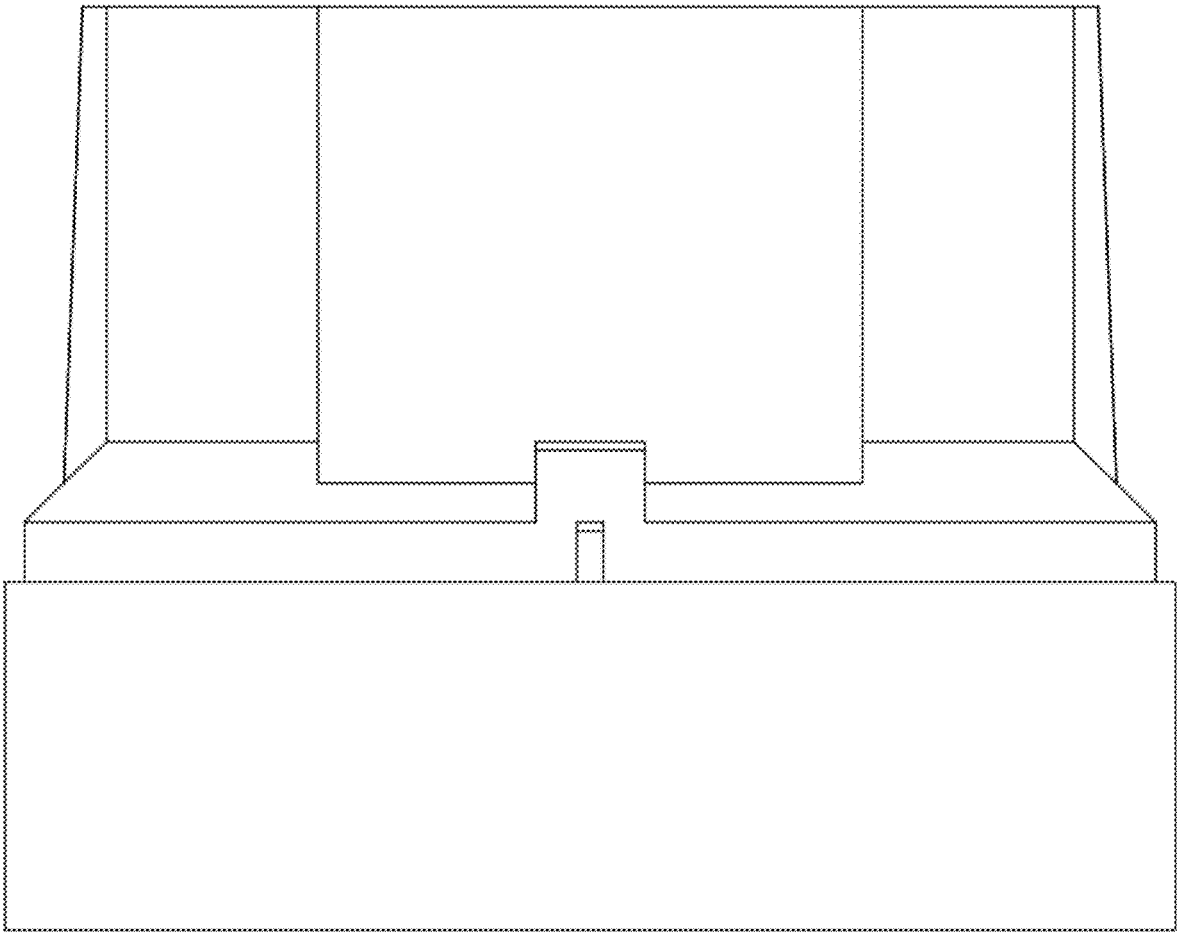
FIG. 5 is a side elevation view of an exemplary embodiment of the universal transition fitting 10 of the present invention.
Figure 6:
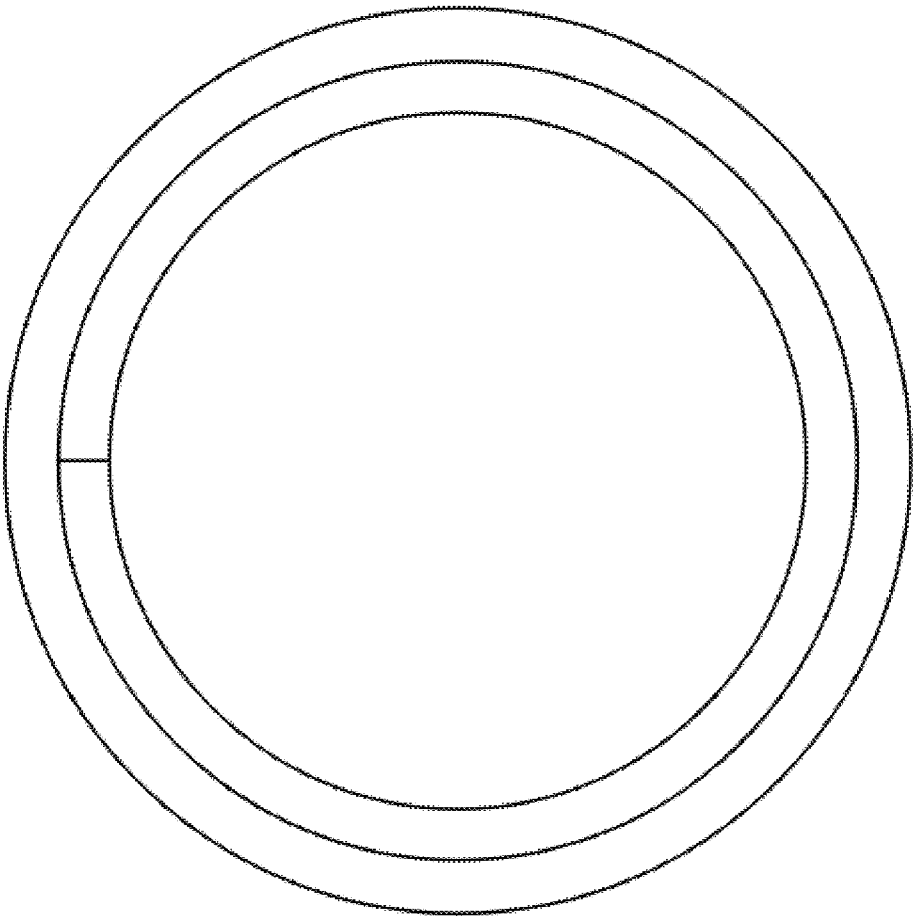
FIG. 6 is a plan view of an exemplary embodiment of the universal transition fitting 10 of the present invention.
Figure 7:
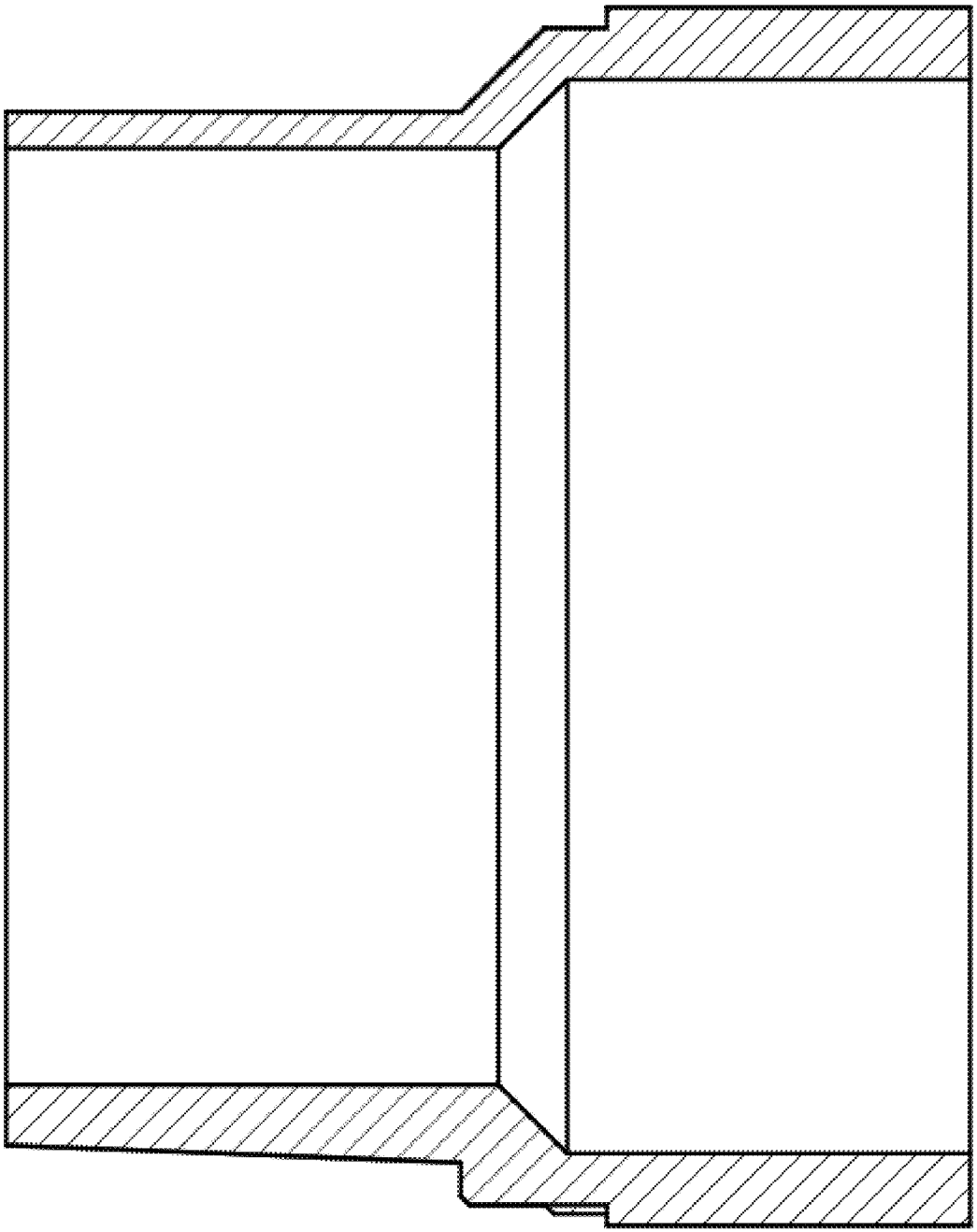
FIG. 7 is a section view of an exemplary embodiment of the universal transition fitting 10 of the present invention.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a termination vent screen assembly that operatively associates with ventilation piping components to prevent undesirables from entry, while enabling sufficient airflow and condensation moisture drainage. Furthermore, the present invention is adapted for installation on many different styles of ventilation piping and fittings, regardless of their manufacturer, whereby the termination vent screen assembly can go over a ventilation pipe, into the ventilation pipe, into a gasketed or non-gasketed hub fitting.

Referring now to FIGS. 1 through 20, the present invention may include a termination vent screen assembly 100 providing a universal transition fitting 10, a screen portion 20, and an escutcheon plate 30.

The transition fitting 10 may be installed into a pre-existing fitting or over a ventilation pipe securely, with no glue or adhesive required.

The transition fitting 10 has a proximal end 12 and a distal end 14. Generally speaking, the proximal end 12 has a greater outer diameter than the distal end 14. As a result, the distal end 14 can fit into the inner diameter of a venting conduit (pipe or fitting). Even though not shown in the illustrations, the distal end 14 may have a smooth exterior, with no wedge flanges 15. An arcuate notch 16 may separate the distal end 14 and the proximal end 12. The proximal end 12 typically fits over a venting conduit. The arcuate notch 16 may provide spaced apart nodes 18 for snapping on the escutcheon plate 30. The escutcheon wall plate 30 securely fastens onto the outside diameter (OD) of transition fitting 10, by way of the nodes 18 and the arcuate notch 16, and is dimensioned and adapted to cover the drilled hole gap in a supporting structure (e.g., sidewall) around the ventilation pipe.

Figure 8A:
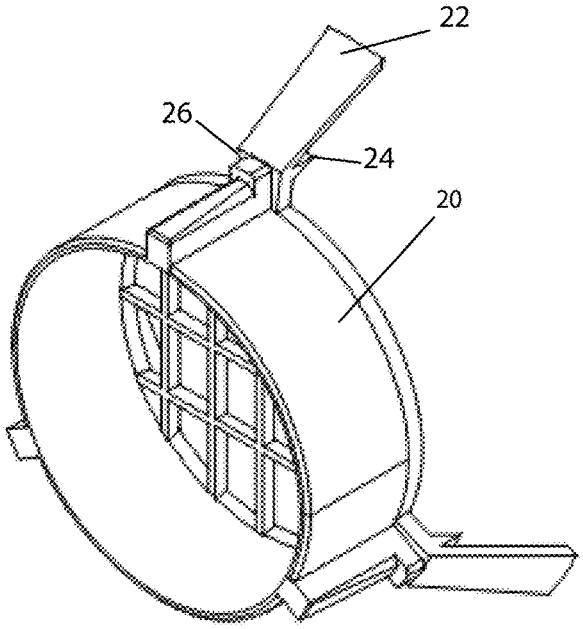
FIG. 8A is a proximal perspective view of an exemplary embodiment of a vent portion 20 of the present invention.
Figure 8B:
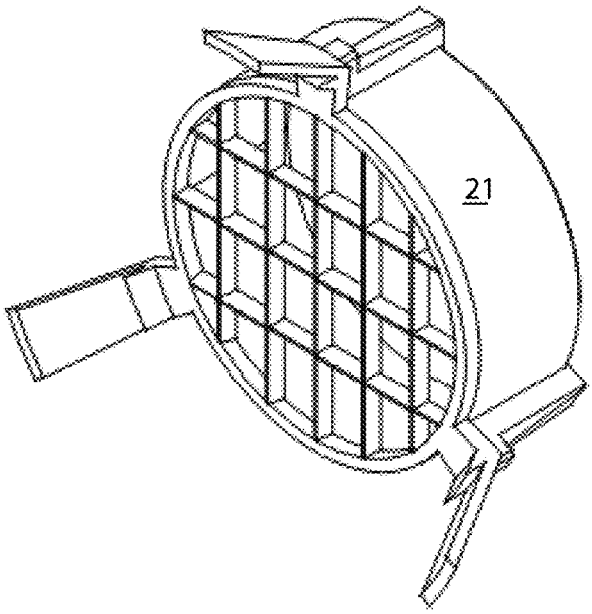
FIG. 8B is a distal perspective view of an exemplary embodiment of the vent portion 20 of the present invention.
Figure 9:
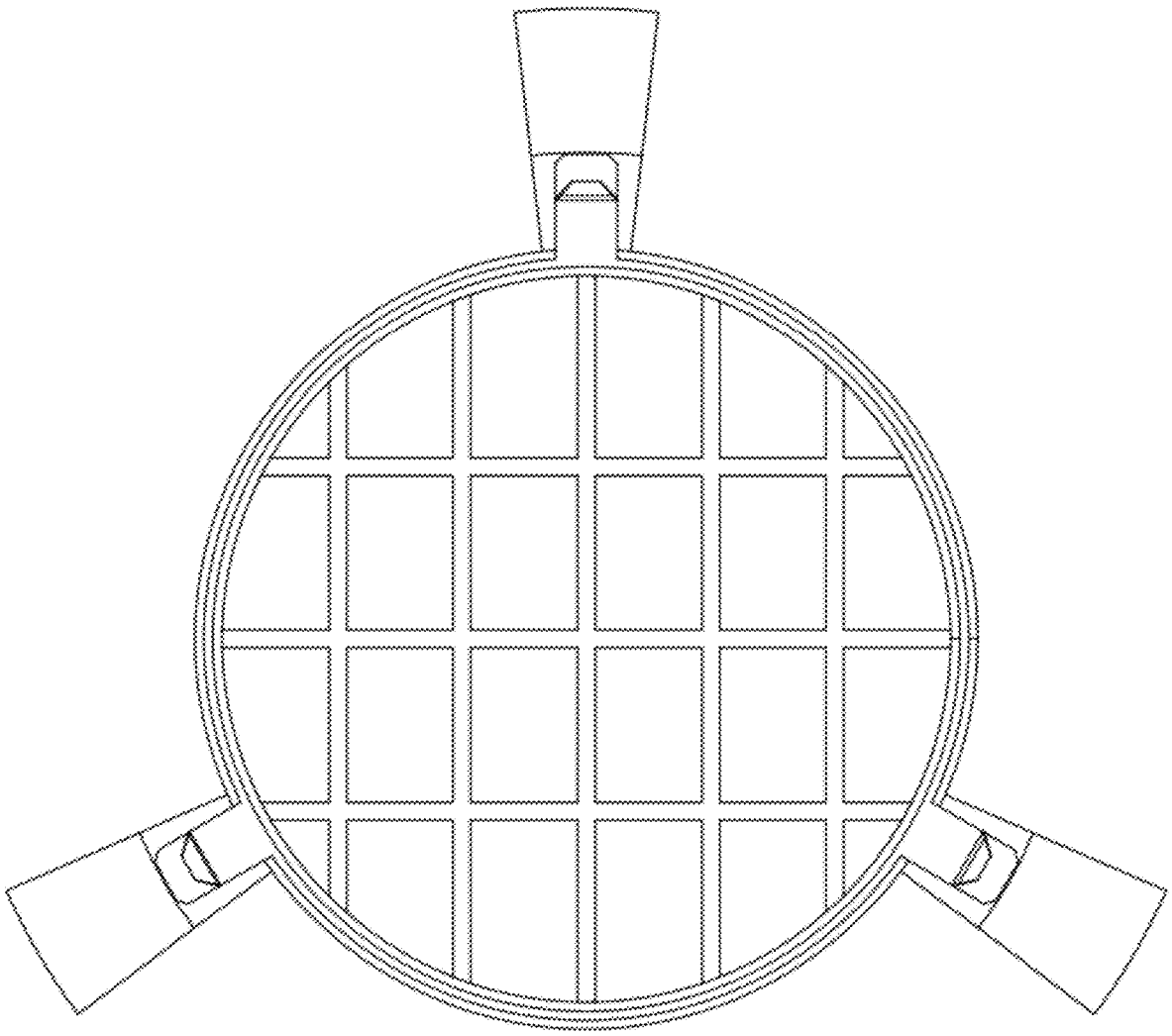
FIG. 9 is a proximal plan view of an exemplary embodiment of the vent portion 20 of the present invention.
Figure 10A:
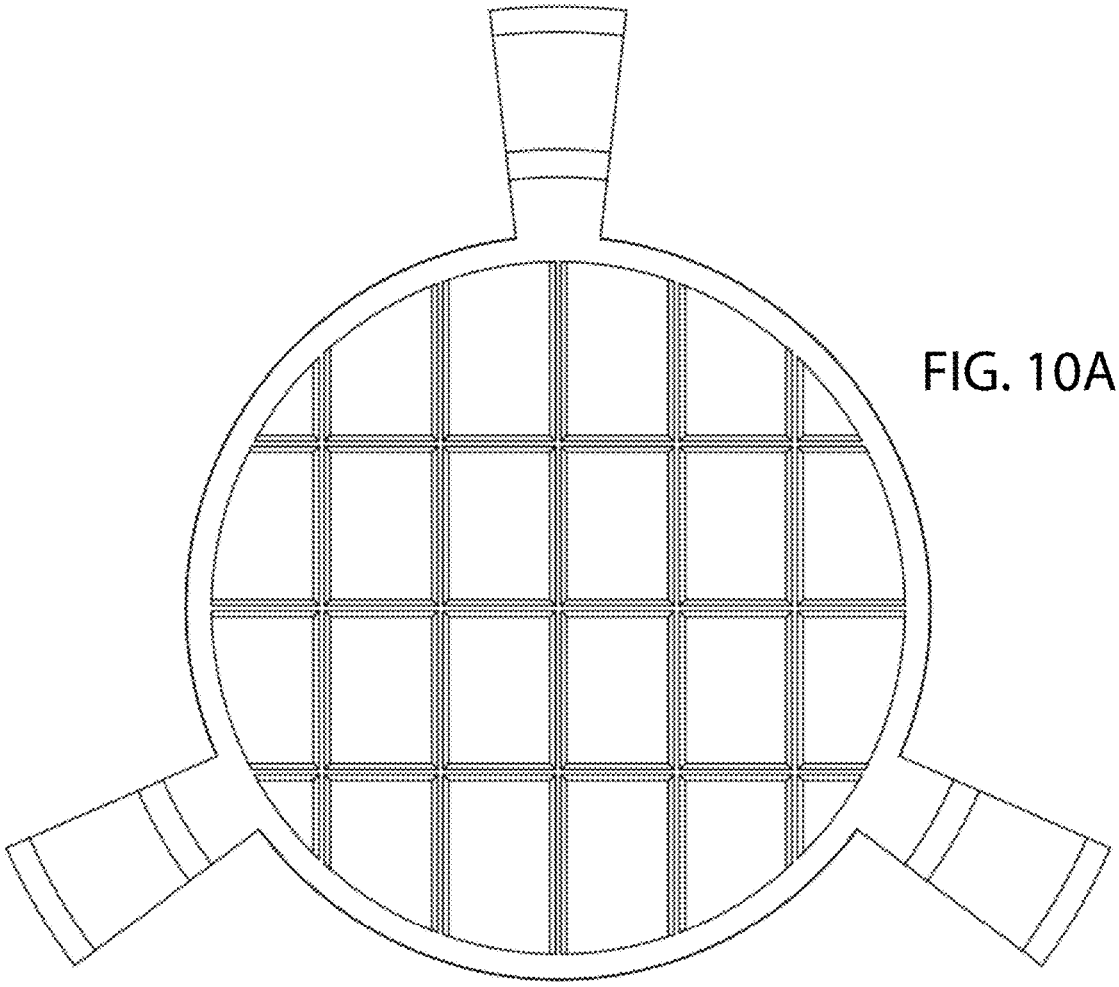
FIG. 10A is a distal plan view of an exemplary embodiment of the vent portion 20 of the present invention.
Figure 10B:
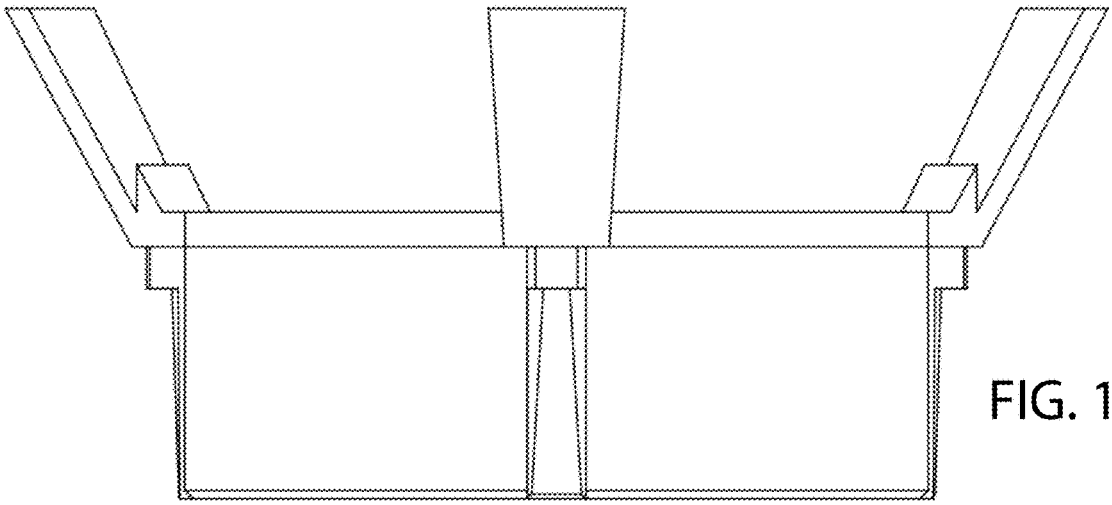
FIG. 10B is a side elevation view of an exemplary embodiment of the vent portion 20 of the present invention.
Figure 11:
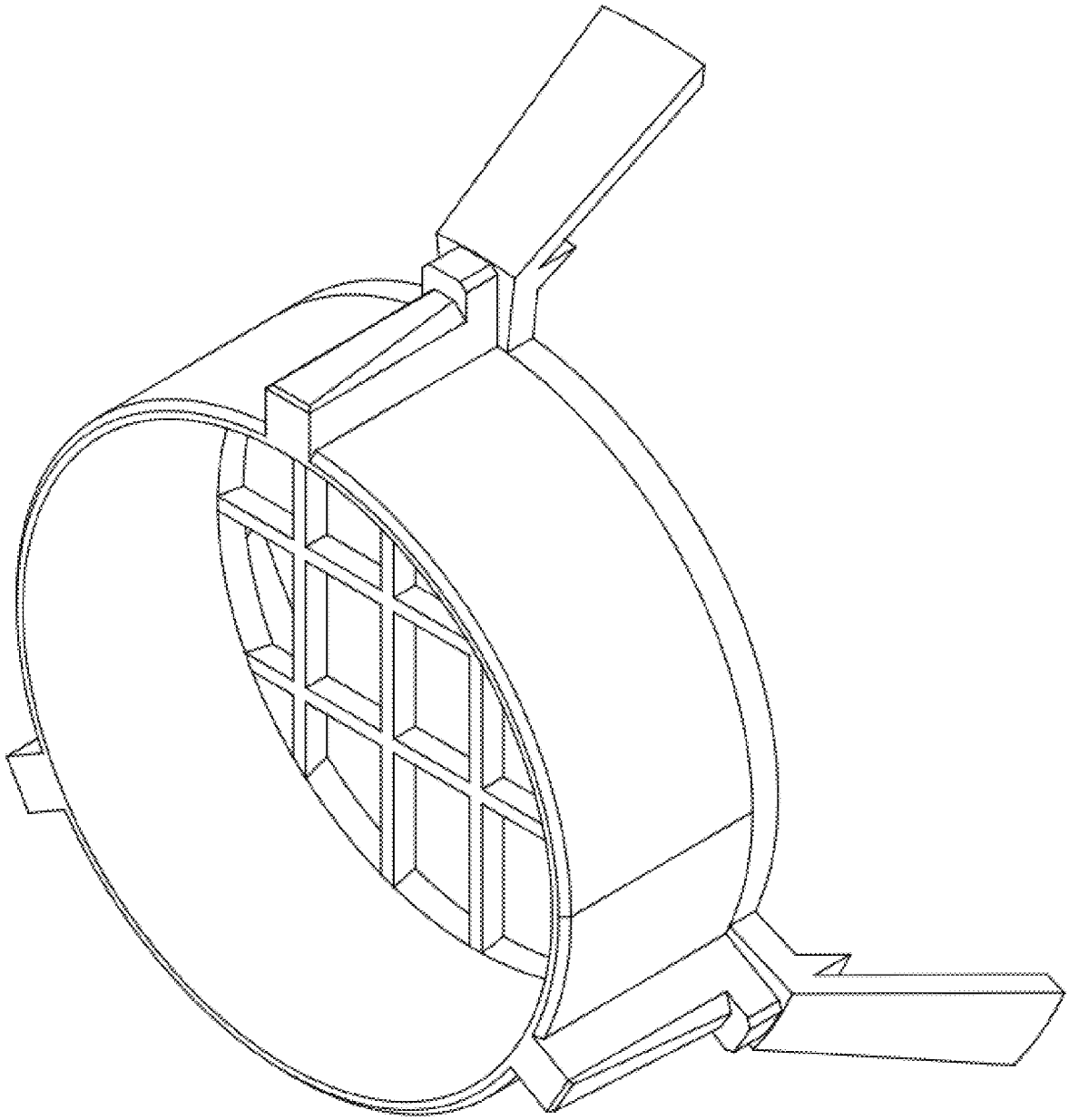
FIG. 11 is a proximal perspective view of an exemplary embodiment of the vent portion 20 of the present invention.
Figure 12:
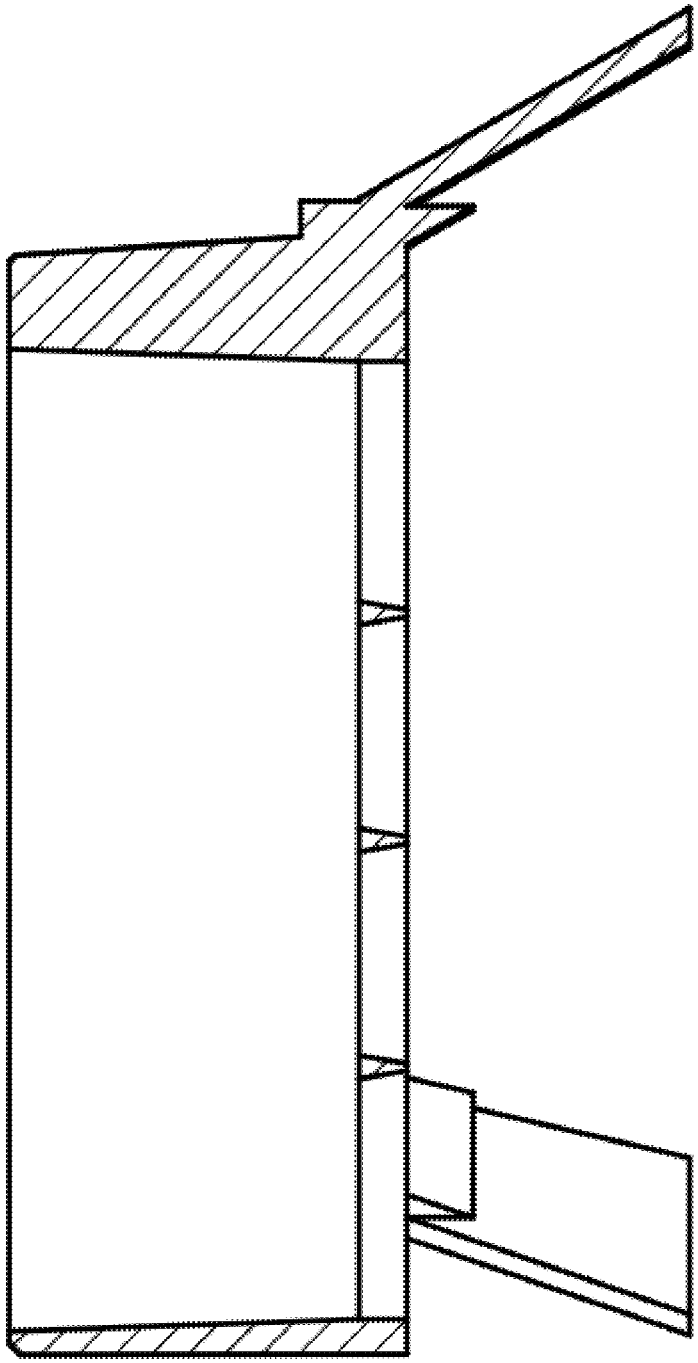
FIG. 12 is a section view of an exemplary embodiment of the vent portion 20 of the present invention.
Figure 13:
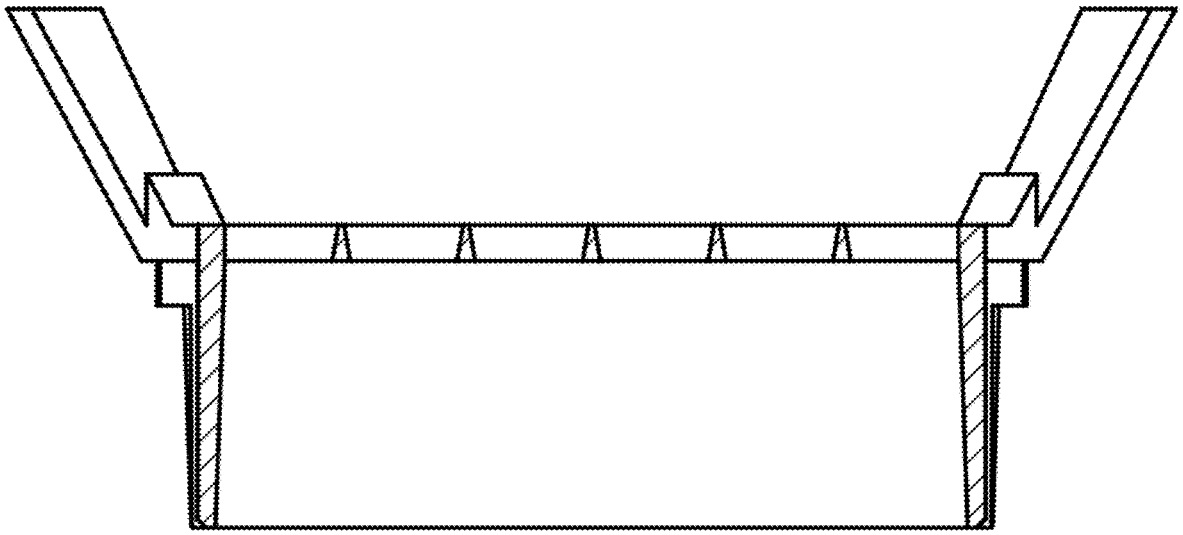
FIG. 13 is a section view of an exemplary embodiment of the vent portion 20 of the present invention.
Figure 14:
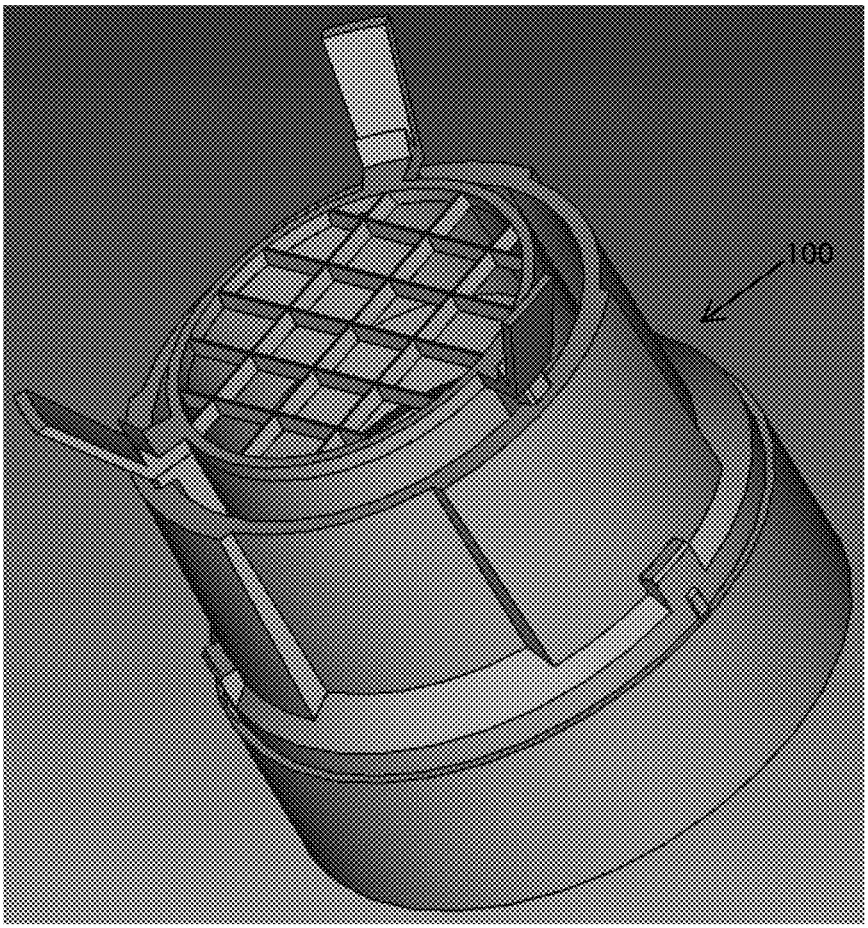
FIG. 14 is a distal perspective view of an exemplary embodiment of the present invention, shown in an assembled condition, as an assembly 100 embodying the of the vent portion 20 nested in the universal transition fitting 10.
Figure 15:
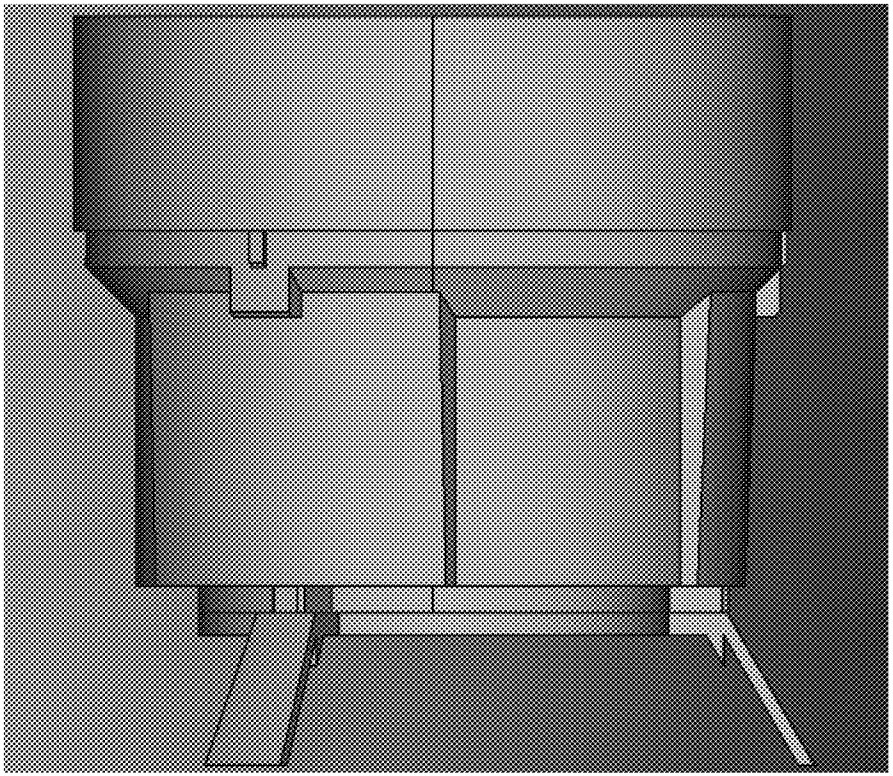
FIG. 15 is a side elevation view of an exemplary embodiment of the present invention, showing the assembly 100 in the assembled condition.
Figure 16:
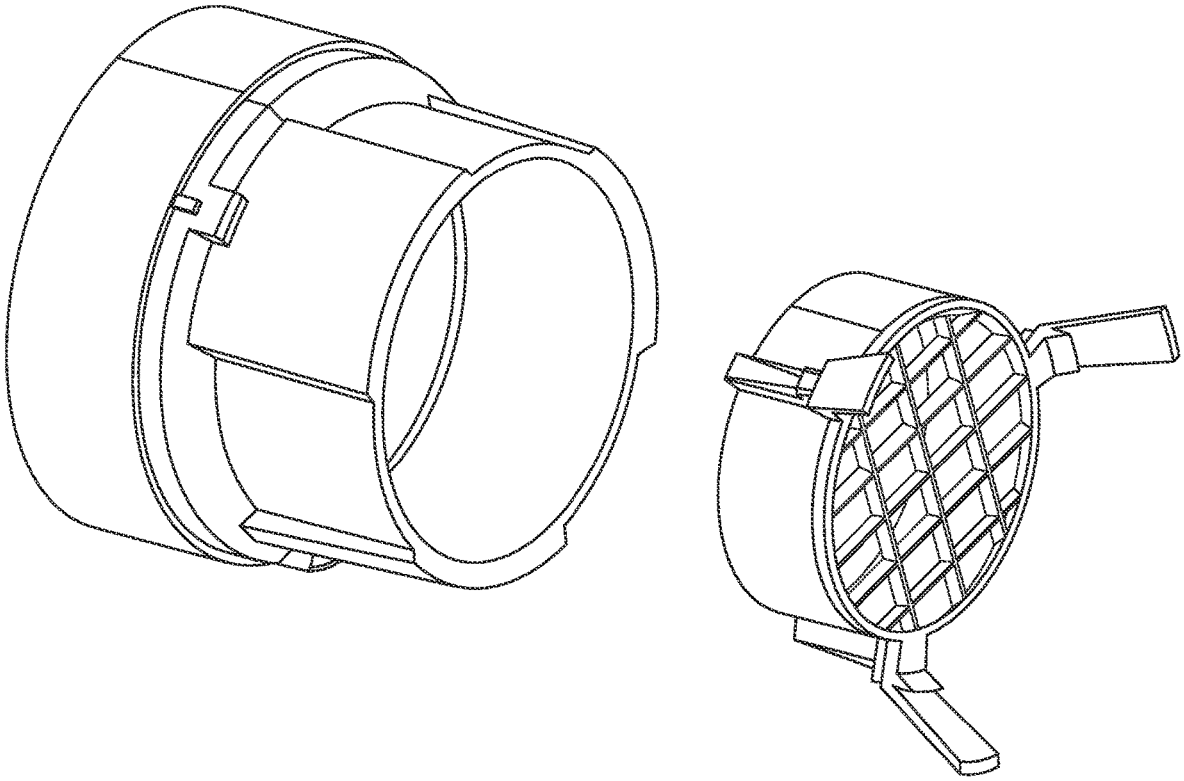
FIG. 16 is an exploded distal perspective view of an exemplary embodiment of the assembly 100 of the present invention.
Figure 17:
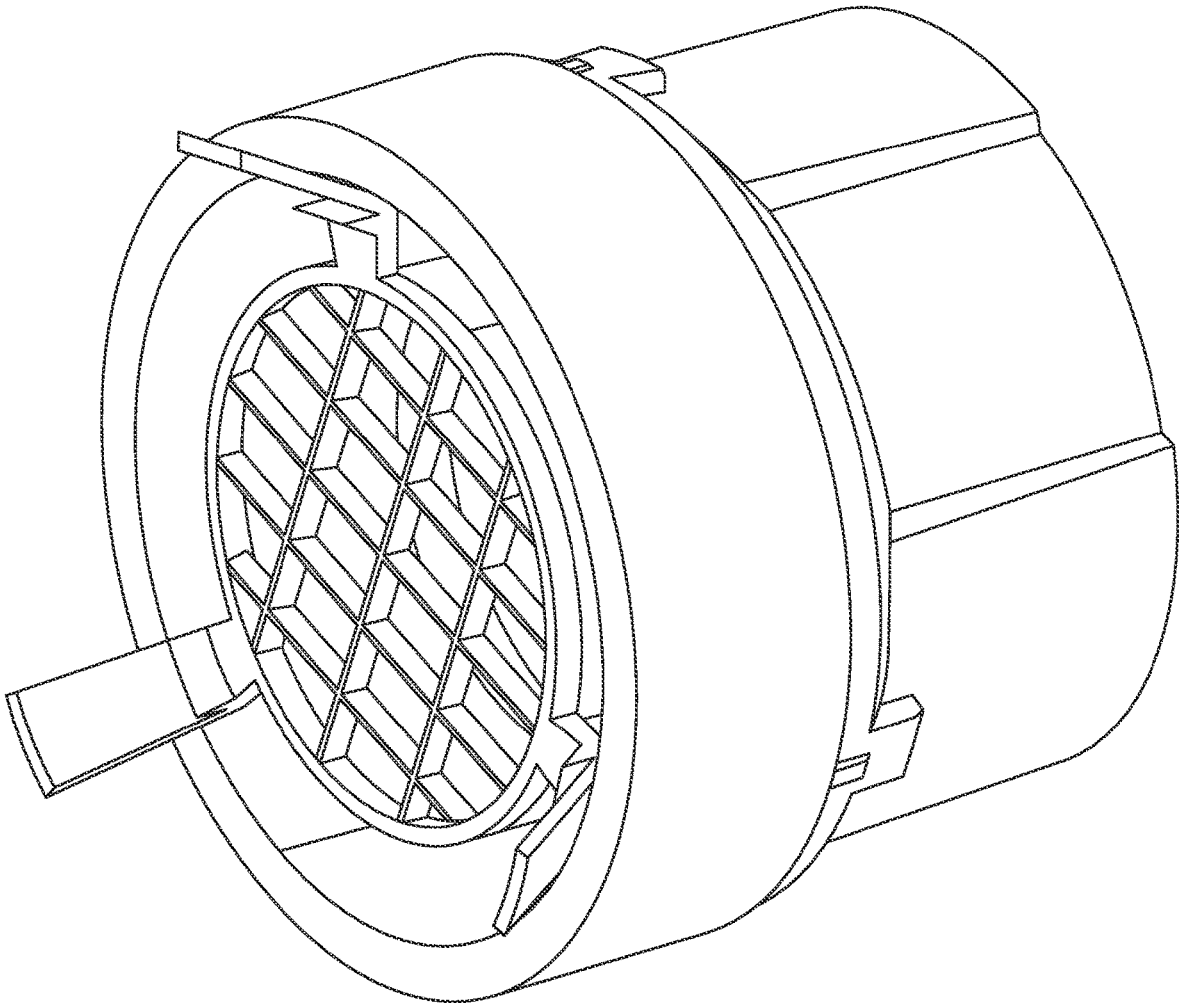
FIG. 17 is a distal perspective view of an exemplary embodiment of the assembly 100 of the present invention, shown in the assembled condition.
Figure 18:
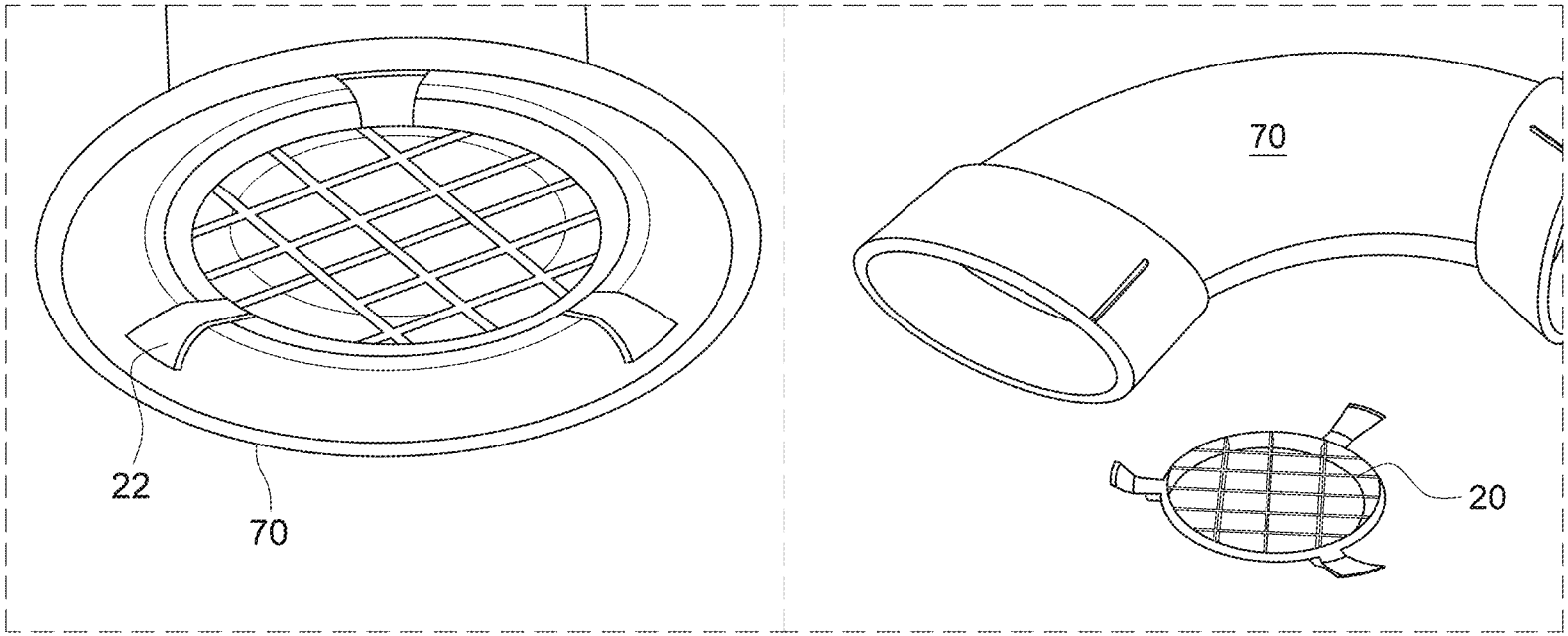
FIG. 18 shows an elevation view of the screen portion 20 with its legs 22 in the distal position engaging the inner walls of a conduit 70; and shows a perspective view with the screen portion 20 removed from the conduit.
Figure 19:
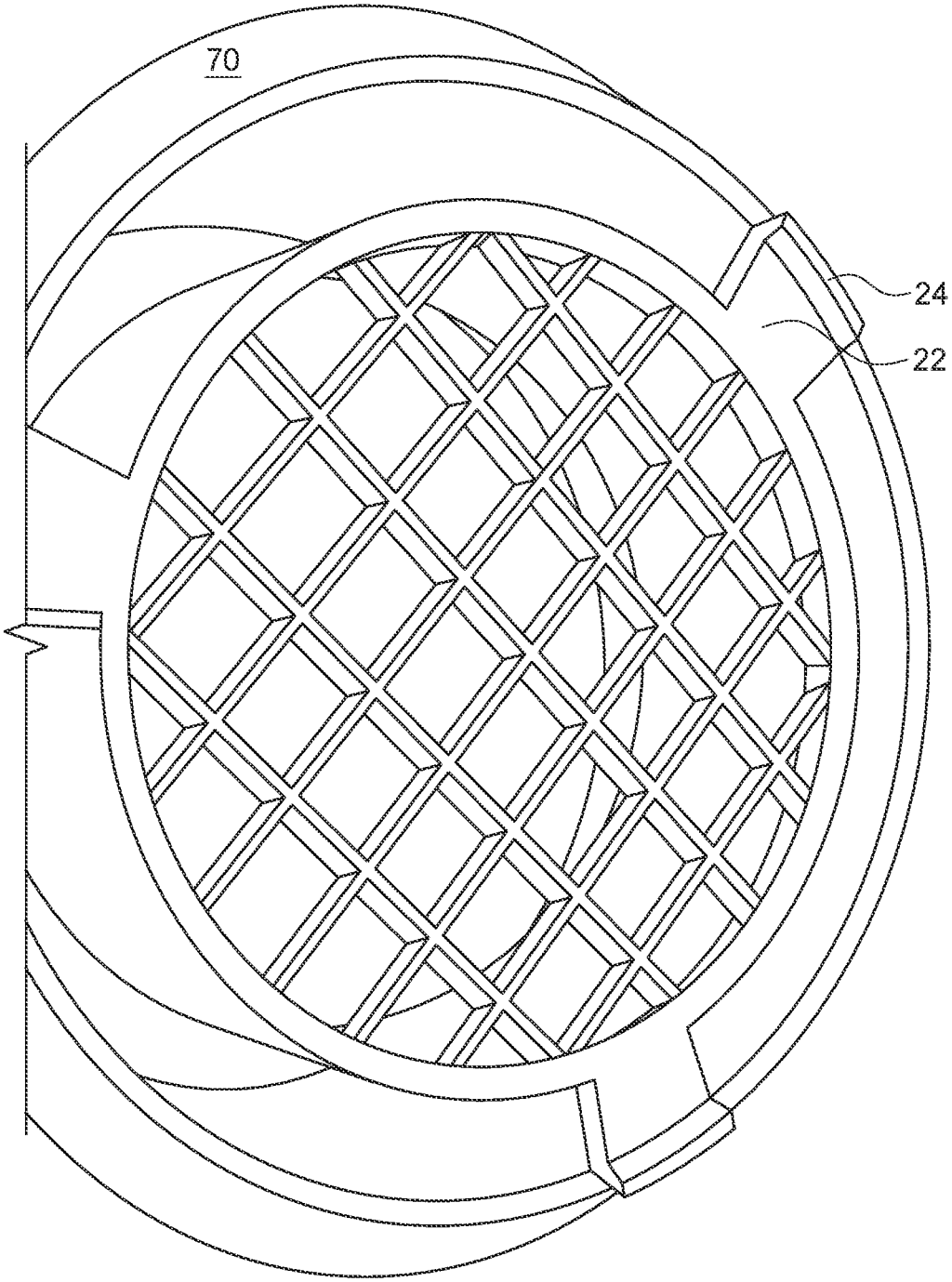
FIG. 19 is a perspective view of an exemplary embodiment of the present invention showing the screen potion 20 engaging an inner wall of a conduit 70 with the legs 22 of the screen portion 20 in the proximal position, and wherein the stops 24 in effect engaging and wedging against the inner wall of the conduit 70.
Figure 20:
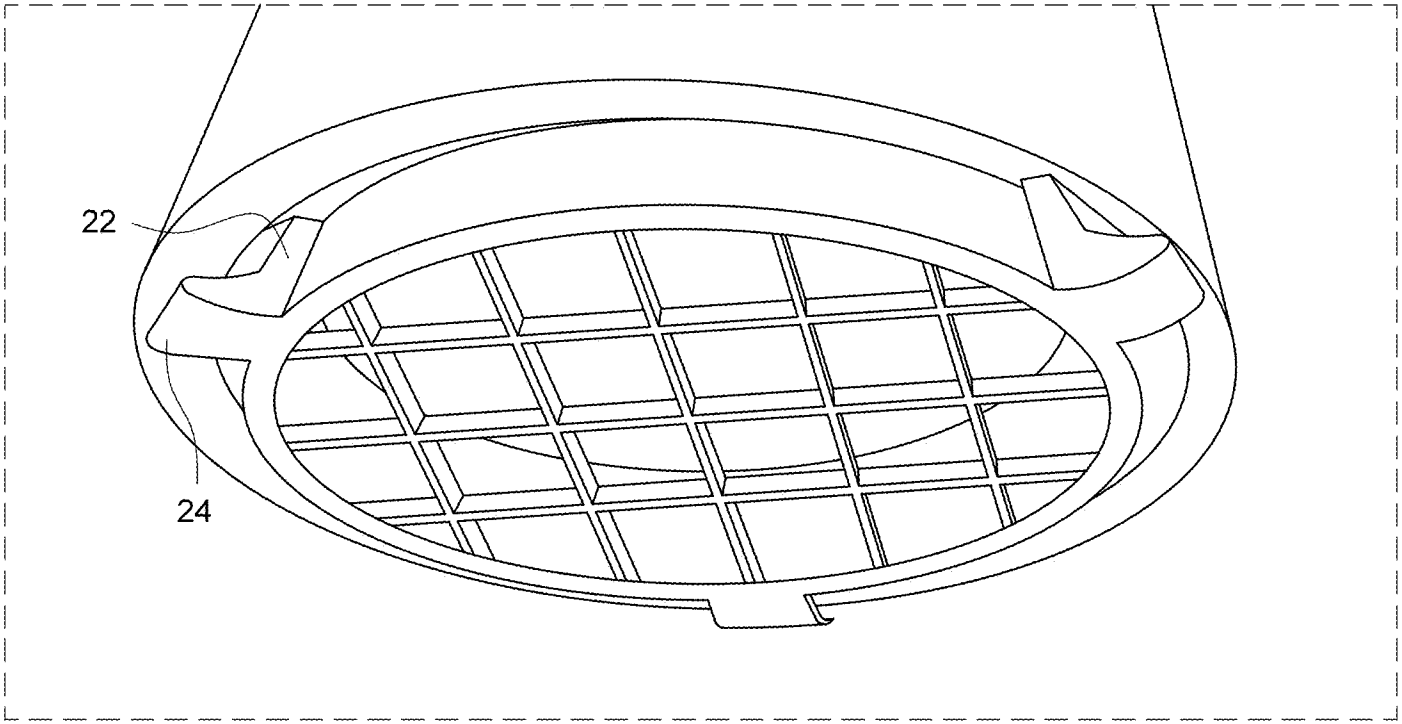
FIG. 20 is a perspective view of an exemplary embodiment of the present invention showing the screen potion 20 engaging an inner wall of a conduit 70 with the legs 22 of the screen portion 20 in the proximal position, illustrating the stops 24 outside of the conduit 70.

The screen portion 20 installs into the center of the transition fitting 10 which blocks undesirables from entry into the inherent ventilation system. The screen portion 20 may provide a plurality of spaced apart "spider" legs 22 that extend distally away from the arcuate body 21 of the screen portion 20. Each leg 22 may pivot about a pivot connection 26 so as to pivot approximately 180 degrees (from projecting forward of its distal end to extending proximately toward the proximate end opposite the distal end). In other words, each leg pivots between a distal position and a proximal position. Adjacent the pivot connection 26 is a stop 24 that projects forward of the distal end. The legs 22 may be biased in the forward/distal direction as shown in FIG. 8B. In this distal position the legs 22 extend radially outward and upward so that a circle defined by the outermost tips of the plurality of legs 22 would have a diameter approximately twenty to forty percent larger than the diameter of the arcuate body 21

As a result, in the biased position, the screen portion 20 may engage the inner circumference of a hub or fitting by way of the distal-positioned legs 22. Selectively, a user can pivot each leg 22, by way of the pivot connection 26, so that the vent portion 20 can be wedged into the inner circumferential walls of a pipe, which tend to have a smaller inner diameter than hubs and fittings. The stop 24 tends to be a rigid structure that facilitates the said wedging as the stop 24 is angled upward so that the stop 24 acts a tapered surface for forming a wedged fit. Accordingly, the vent portion 20 can be removed or separated from the assembly 100 and used as a standalone device.

Due to the "Free Open Air" (FOA) configuration, the present invention allows water condensation drainage and maximum airflow capacity into or exhausting from the operatively associated ventilation pipe.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A vent assembly for a ventilation conduit, the vent assembly comprising:

a vent portion comprising:

an arcuate body extending between a distal end and a proximal end;

a plurality of legs radially spaced apart along the distal end, wherein each leg, in a biased position, extends distally so that a free end thereof projects beyond said distal end and so that the free ends of the plurality of legs define circle have a diameter approximately twenty to forty percent greater than a diameter of the arcuate body; and for each leg, a pivot connects the leg to the arcuate body so that the leg moves between the biased position to a proximal position projecting toward the proximal end of the arcuate body.

2. The vent assembly of claim 1, further comprising, for each leg, a stop disposed adjacent to the pivot so that the stop projects beyond the distal end an outermost diameter when the position.

3. The vent assembly of claim 2, further comprising, a transition fitting being tubular and having distal portion and a proximal portion, wherein an outer diameter of the proximal portion is approximately at least five percent greater than a diameter of the distal portion, wherein the distal portion is dimensioned and shaped to have a portion of the arcuate body nest therein while no portion of the arcuate body nests in the proximal portion, and wherein a remaining portion of the arcuate body projects outward from the distal portion away from the proximal portion.

4. The vent assembly of claim 3, further comprising, an arcuate notch between the distal portion and the proximal portion.

5. The vent assembly of claim 4, further comprising a plurality of nodes spaced apart along the arcuate notch.

6. The vent assembly of claim 5, further comprising an escutcheon plate dimensioned and adapted to snap on to the arcuate notch and the plurality of nodes.

7. The vent assembly of claim 6, wherein the arcuate body defines an opening; and further comprising a mesh vent coextensive with the opening, wherein the mesh vent is defined by at least ninety-five percent of free open area.

8. The vent assembly of claim 3, wherein the plurality of legs interfaces with the transition fitting.

* * * * *